US008752914B1

(12) United States Patent
Simhoni

(10) Patent No.: US 8,752,914 B1
(45) Date of Patent: Jun. 17, 2014

(54) DISH RACK MOUNTED IN KITCHEN CABINET

(76) Inventor: Tali Simhoni, Miami Beach, FL (US)

( * ) Notice: Subject to any disclaimer, the term of this patent is extended or adjusted under 35 U.S.C. 154(b) by 44 days.

(21) Appl. No.: 13/609,602

(22) Filed: Sep. 11, 2012

Related U.S. Application Data

(60) Provisional application No. 61/533,844, filed on Sep. 13, 2011.

(51) Int. Cl.

| | |
|---|---|
| ***A47B 67/02*** | (2006.01) |
| ***A47F 5/08*** | (2006.01) |
| ***A47B 51/00*** | (2006.01) |
| ***A47B 77/08*** | (2006.01) |

(52) U.S. Cl.
USPC ..... 312/247; 312/312; 312/229

(58) Field of Classification Search
USPC ..... 312/247, 312, 229, 228.1, 306; 211/117, 41.4
See application file for complete search history.

(56) References Cited

U.S. PATENT DOCUMENTS

| | | | | |
|---|---|---|---|---|
| 1,037,073 | A * | 8/1912 | Sonnemann | 134/200 |
| 1,860,617 | A | 5/1932 | Krause | |
| 2,328,129 | A | 8/1943 | Earle | |
| 2,382,354 | A * | 8/1945 | Wales | 312/247 |
| 2,538,233 | A * | 1/1951 | Brandstrom | 312/242 |
| 2,550,539 | A * | 4/1951 | Earle | 312/228 |
| 2,580,784 | A | 1/1952 | Hoppe | |
| 2,635,027 | A * | 4/1953 | Rasmussen | 312/229 |
| 2,824,567 | A | 2/1958 | Karlstrom | |
| 2,852,030 | A * | 9/1958 | Nord | 134/179 |
| 2,854,307 | A * | 9/1958 | Londeree et al. | 312/247 |
| 3,737,209 | A * | 6/1973 | Manor | 312/247 |
| 4,436,352 | A * | 3/1984 | Okada et al. | 312/228 |
| 4,756,582 | A | 7/1988 | Heien | |
| 5,485,927 | A * | 1/1996 | Hubbard | 211/41.3 |
| 6,336,692 | B1 * | 1/2002 | Snyder | 312/312 |
| 6,471,311 | B1 | 10/2002 | Snyder | |
| 6,484,893 | B1 * | 11/2002 | Tkatch | 211/94.02 |
| 6,758,348 | B2 * | 7/2004 | Adkins | 211/41.6 |
| 2004/0099617 | A1 | 5/2004 | Elias et al. | |
| 2006/0138063 | A1 * | 6/2006 | Johnson | 211/41.3 |

* cited by examiner

*Primary Examiner* — Darnell Jayne
*Assistant Examiner* — Timothy M Ayres
(74) *Attorney, Agent, or Firm* — Malin Haley DiMaggio & Bowen, P.A.

(57) ABSTRACT

A dish rack installation kit including a pair of rigid vertical support members connected on each side of said dish rack, said dish rack having a plurality of frame members that can support a variety of different kinds of dishes, said dish rack mounted above a kitchen sink in an upper kitchen cabinet with an open bottom to allow drainage from the dish rack directly into the kitchen sink. The invention can include cabinet doors to hide the dish rack when not in use. The invention saves space in the kitchen. The rigid vertical support members include holes that receive fasteners for attaching the entire unit to the inside walls of a kitchen cabinet.

2 Claims, 6 Drawing Sheets

DISH RACK MOUNTED IN KITCHEN CABINET

CROSS REFERENCE TO RELATED APPLICATIONS

This application claims priority to co-pending U.S. Provisional Patent Application No. 61/533,844 filed on Sep. 13, 2011.

BACKGROUND OF THE INVENTION

1. Field of the Invention

This invention relates to a dish rack installation kit that is strategically mounted above a kitchen sink to save space in a kitchen cabinet having an open bottom. In an alternate embodiment, the dish rack installation kit is mounted in a kitchen cabinet that is suspended from the ceiling or wall above a kitchen sink.

2. Description of Related Art

Dish racks have been used for years when washing dishes to allow the dishes to drain and dry. Typically the dish rack is positioned within a sink or on a countertop. Often on a countertop, a waterproof mat is positioned beneath the dish rack for drainage purposes.

One problem with a conventional dish rack is that it takes up space on a countertop or in a sink. Finding additional kitchen space can be difficult. Using the present invention reduces the amount of space taken up by the disk rack while adding the convenience of draining and drying dishes that are stored in a kitchen cupboard. The dish rack installation kit can be used for new kitchen cupboard installations and as an aftermarket kitchen cupboard installation for existing kitchen cupboards.

The dish rack installed using the installation kit is also capable of supporting fruits and vegetables that have been washed and are placed in the dish rack for drying.

SUMMARY OF THE INVENTION

A dish rack installation kit that includes a dish rack attached on each side to a pair of rigid, vertically-disposed dish rack support members that include fastening apertures for attaching the vertical rack support members to the inside vertical walls of a kitchen cabinet. The dish rack is constructed of an array of dish rack rigid thin frame members that are configured together so they can receive plates, bowls, and other kitchen utensils in a suspended position for drainage purposes, said dish rack frame members including an angled array of spaced apart vertical projecting members for supporting dishes, fruits and vegetables and including open spaces between the frame members that allow water to drain by gravity into a sink below. The vertical rigid dish rack support members are connected on both sides of the dish rack and to the cupboard inside sidewalls. The dish rack is movably connected to the vertical side support members so that the dish rack can be manually moved from a cupboard storage position to a lower support position to allow the loading of dishes, fruits or vegetables into the storage rack in the lower position. The doors of the kitchen cabinet can be closed, hiding the dish rack from view while at the same time the dish rack contains dishes for storage.

The dish rack is suspended over a conventional kitchen sink area so that as the dishes are placed in the dish rack, water from the dishes drains downwardly by gravity into the kitchen sink. When the dish rack is full and the user has completed the task of washing the dishes and placing them in the dish rack, a pair of cabinet doors can be closed, hiding the dish rack behind cabinet doors which appears to be a normal cabinet shelf in the kitchen.

The dish rack installation kit is installed in a cabinet that does not have a bottom cabinet floor or bottom shelf but instead has an open bottom that receives the dish rack to hold wet dishes over the kitchen sink which is positioned at the bottom of the cabinet opening area to drain water from the dishes. The cabinet bottom area, which would have been used as a rigid solid shelf to hold dishes, is an open space filled by the dish rack. This dish rack in a cabinet helps maximize available kitchen space so that the kitchen stays neat and organized. This allows the kitchen to have more uninterrupted usable countertop sink space providing extra space traditionally used to place a dish rack and drain pan into the sink. This design provides a beautiful alternative to drying dishes while it hides unsightly washed dishes. Fruits and vegetables can also be washed and drained using the dish rack.

Using the dish rack installation kit the dish rack can be installed quickly and easily using screws that attach the rigid vertical support members to the inside walls of the selected kitchen cabinet that has an open bottom. The dish rack containing cabinet may be one of a set of cabinets installed in a kitchen. The other cabinets will serve as storage for food, cooking equipment, dishes and other items found in the kitchen. The cabinets are vertically mounted on the walls or from the ceiling in the kitchen.

The installation kit for the dish rack can be installed in any cabinet with an open bottom. All of the upper cabinets are hung on conventional cabinet mounting supports or rails attached to the wall. This will make it easy to have all of the cabinets functional. The rail can be carefully placed on the wall at the proper horizontal and vertical angles and this guarantees that the cabinets will be straight. The cabinets could also be mounted in such a way that they could be easily removed, based on the type of fasteners used. If bolts were used, the user could loosen the bolts hidden by plastic covers and the cabinets will be removable from the wall.

In an alternate embodiment, the supported dish rack is enclosed in its own kitchen cabinet and the cabinet is suspended above the kitchen sink from above from the ceiling or wall. It is positioned over a conventional kitchen sink so that as the dishes are placed in the dish rack, water from the dishes drains downwardly by gravity into the kitchen sink. When the dish rack is full and the user has completed the task of washing the dishes and placing them in the dish rack, a pair of cabinet doors can be closed, hiding the dish rack in cabinet which appears to be an ornamental cabinet in the kitchen. The installation kit is used to install dish rack even in an individual cabinet that is supported from the ceiling or wall.

This hanging kitchen cabinet set includes one cabinet that is installed with a dish rack installation kit (constructed with stainless steel and/or a microbial-resistant plastic coated metal or any material such as plastic or aluminum) to hold wet dishes over the kitchen sink which is positioned above a sink drain to drain drips of water. The bottom area of the cabinet is an open space filled by the dish rack. This cabinet will help maximize space so that the kitchen stays neat and organized. This allows the kitchen to be used with uninterrupted usable countertop/sink space, providing extra space traditionally used to place a dish rack and drain pan into the sink. This product is designed to provide a beautiful alternative to drying dishes while it hides unsightly washed dishes.

The cabinet is hung over the kitchen sink on conventional cabinet mounting supports, hooks, fasteners, or rails attached to the ceiling or wall. The rail can be carefully placed on the ceiling or wall at the proper horizontal and vertical angles to ensure that the cabinet will be directly above the sink.

In an alternate embodiment a dish rack alone could be suspended from the ceiling or wall by a chain or wall and include a vertical adjustment means for raising and lowering of dish rack relatively above the kitchen sink.

The dish rack containing cabinets can be sold through specialty retailers, kitchen remodelers, home centers, online retailers, and ready to assemble furniture manufacturers.

It is an object of this invention to provide an installation kit for a dish rack that is mounted in a kitchen cabinet having an open bottom over the kitchen sink for drainage to save space in the kitchen.

It is another object of this invention to provide an installation kit for a movable dish rack mounted in a kitchen cabinet having an open bottom area above a kitchen sink along with doors for hiding the dish rack when not in use.

PREFERRED EMBODIMENT OF THE INVENTION

Figure 1:
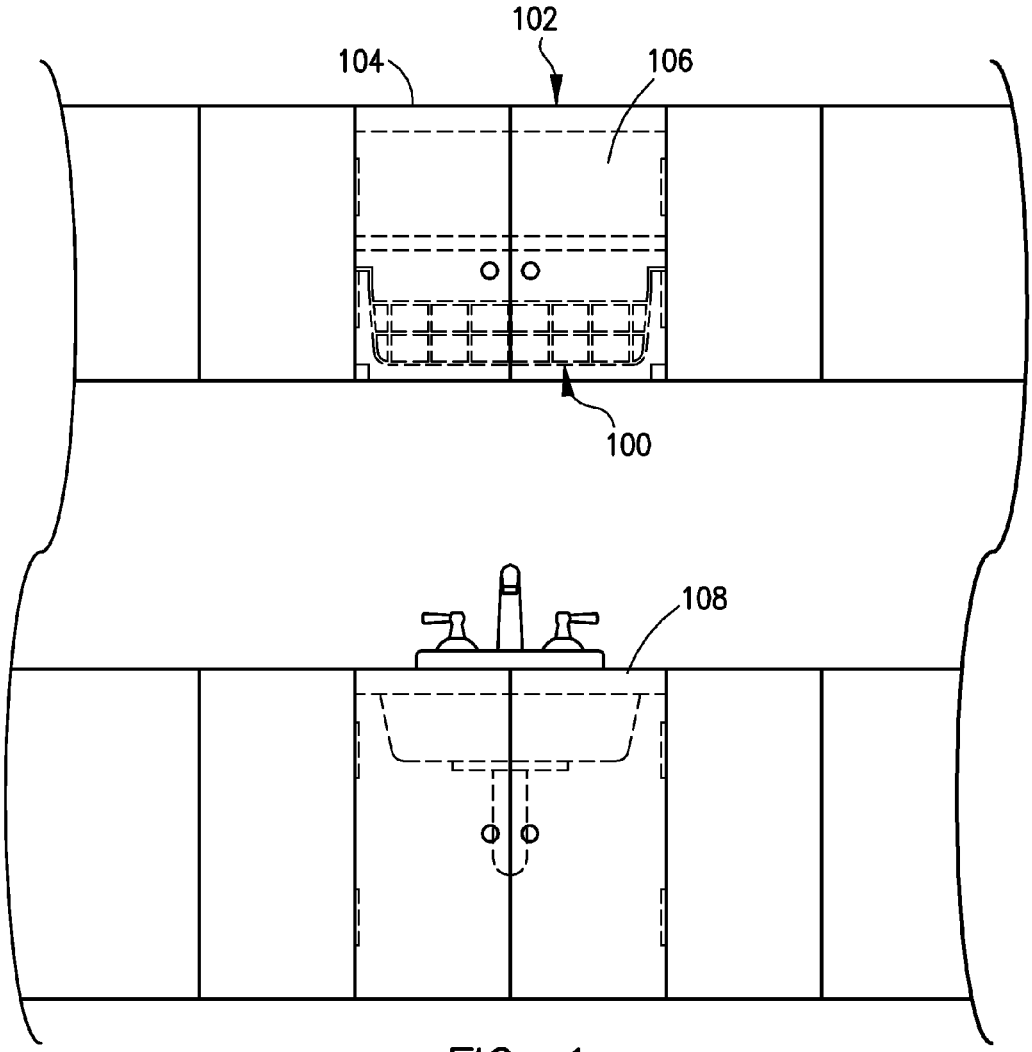
FIG. 1 shows a front elevational view of the invention mounted over a kitchen sink with the cabinet doors closed and the dish rack in phantom.

A dish rack 100 including a plurality of dish rack support frame members for supporting different types of dishes and kitchen utensils, said dish rack 100 permitting water to drip down through the dish rack, said dish rack being mounted in a kitchen cabinet 102 with an open bottom area above the kitchen sink 108. In one embodiment the dish rack is made of stainless steel frame members and is assembled in the cabinet 102 as a kit.

Kitchen wall storage cabinets can vary in depth but are often 12 inches deep. The height of kitchen cabinets is often 30 inches. While cabinets are often called "upper cabinets", the distance from the countertop to a wall cabinet is usually 18 inches. Referring now to the drawing, applicant's invention is shown with a center disposed dish rack 100 vertically mounted between two kitchen cabinet walls which are suspended over a kitchen sink 108 to allow drip drainage by gravity down into the kitchen sink 108 from dishes being placed in the dish rack. A pair of cupboard doors 106 is used to hide the dish rack when not in use by closing the cupboard doors. Thus the kitchen cabinets would be mounted with an open bottom shelf below the dish rack 100 itself so that drainage can be directly into the kitchen sink 108. The dish rack 100 can have various layers of horizontal dish support members which can be rigid metal, plastic or wood bars or rods connected together as a unit for supporting different types of dishes, glasses, bowls, plates, fruits and vegetables and the like. The important aspect of the invention is that whatever the ultimate structure of the dish rack 100 is that the system is meant as a kitchen upper cabinet directly over the kitchen sink for direct drainage down to the sink. Thus the dish rack also serves as a storage area for dishes even when they are dry and the cabinet doors can be closed.

Figure 2:
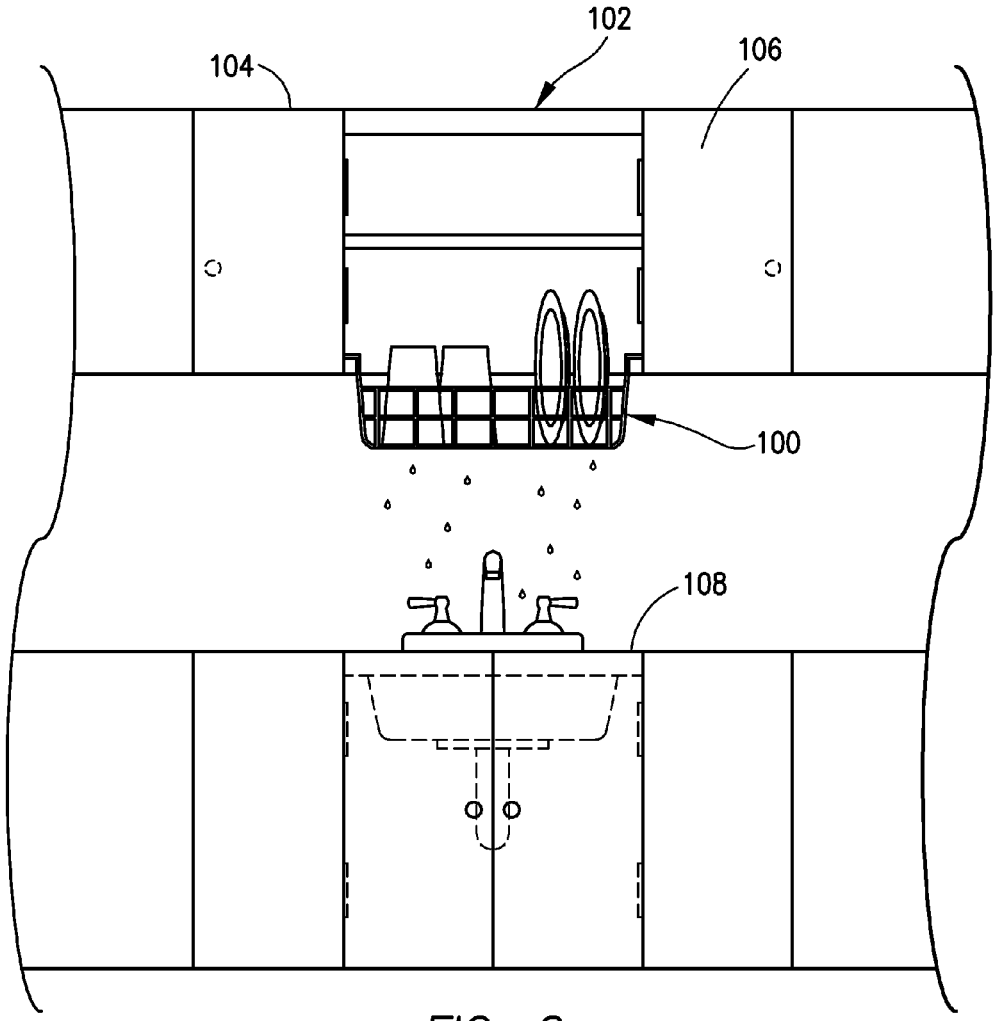
FIG. 2 shows a front elevational view of the invention with the cabinet doors open.

FIG. 1 shows the invention with dotted lines showing the dish rack 100 suspended in a kitchen upper cabinet 102 well above a kitchen sink 108 which is also shown in phantom. In the embodiment in FIG. 1 the cabinet doors 106 are closed. FIG. 2 shows the same embodiment as in FIG. 1 with the cabinet doors 106 open and the dish rack 100 lowered to a different support area closer to the sink and with water drops reaching downwardly into the sink while the dishes and glasses are shown drying.

The dish rack itself can be many different forms as long as the dish rack has an open framed network so that water can drain downwardly from the cabinet area. The dish rack 100 can be movable from a first position as shown in FIG. 1 with a first support to a second position as shown in FIG. 2 during the stacking and dishwashing operation. In fact, the dish rack 100 can be loaded with dishes and actually placed back to the storage position shown in FIG. 1 with the doors closed so that it acts as another cabinet for storing dishes.

Figure 1A:
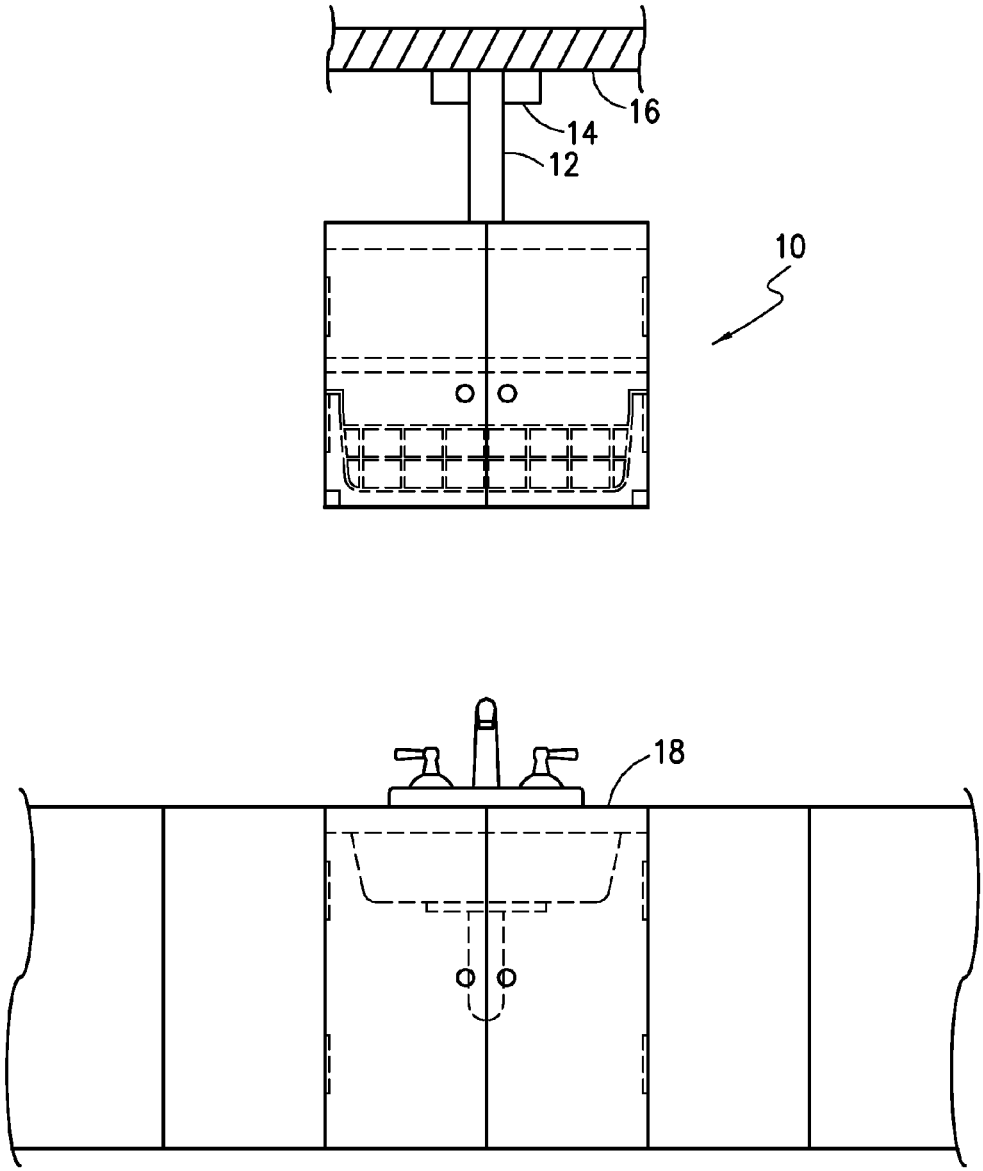
FIG. 1A shows a front elevational view of an alternate embodiment the invention suspended over a kitchen sink with the cabinet doors closed and the dish rack in phantom.
Figure 2A:
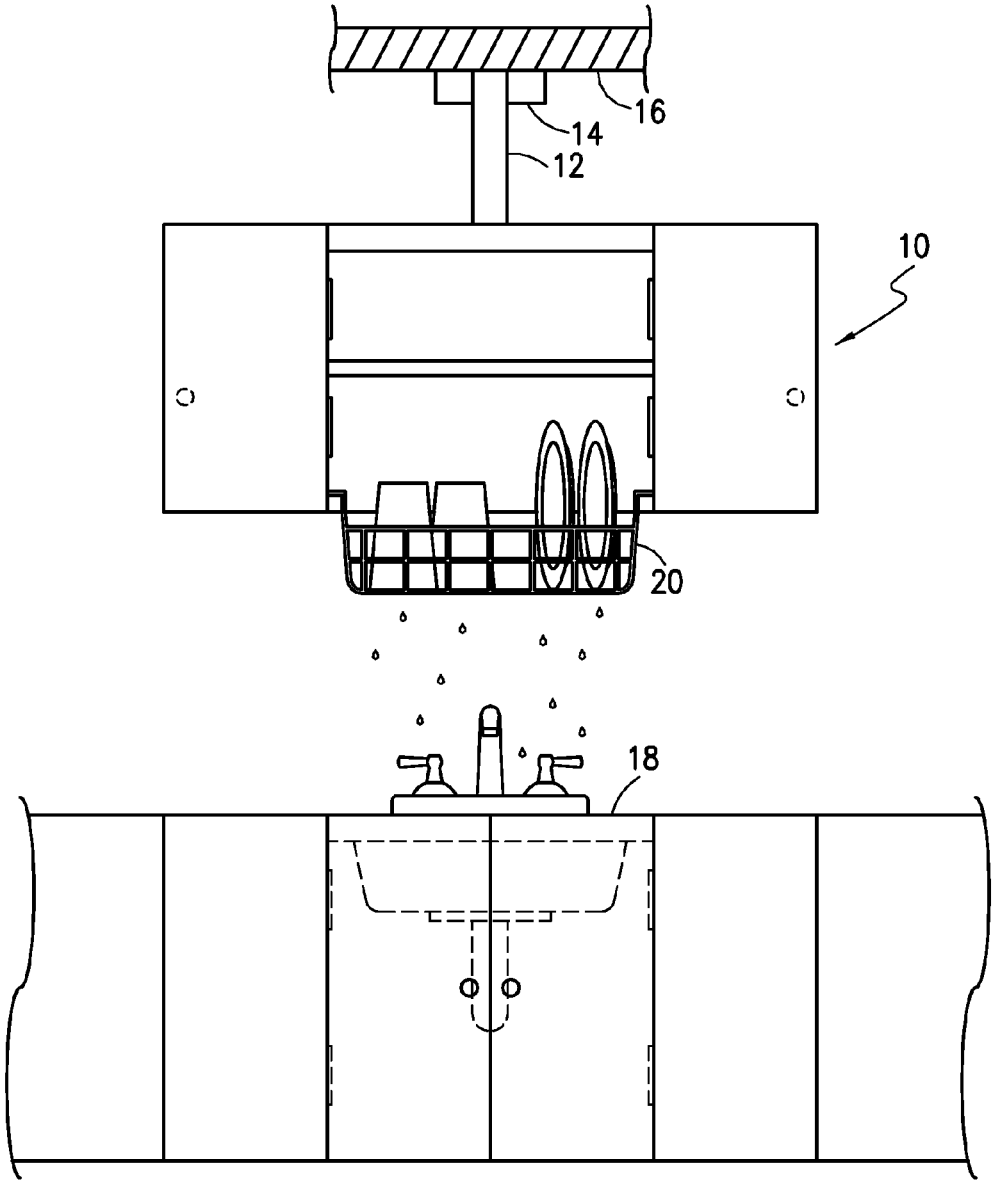
FIG. 2A shows a front elevational view of an alternate embodiment of the invention with the cabinet doors open.

Referring to FIG. 1A and FIG. 2A, a dish rack 20 including a plurality of dish support frame members for supporting different types of dishes and kitchen utensils is shown, said dish rack permitting water to drip down through the dish rack, said dish rack being mounted in a hanging cabinet 10 by support arm 12 connected to ceiling 16 by support 14 with an open bottom area above the kitchen sink 18. In one embodiment the dish rack 20 can be made of stainless steel and/or other microbial-resistant plastic or plastic coated metal frame members. The outer storage cabinet 10 may be made in different designs such as wood, mirror glass, steel, bronze, and the like.

Kitchen wall storage cabinets can vary in depth but are often 12 inches deep. The heights of kitchen cabinets are often 30 inches. While cabinets are often called "upper cabinets", the distance from the countertop to a wall cabinet is usually 18 inches. Referring now to the drawing applicant's invention is shown with a center disposed dish rack vertically suspended by suspended fastener 12 and connector 14 attached to ceiling 16 over a kitchen sink 18 to allow drip drainage by gravity down into the kitchen sink from dishes being placed in the dish rack. A spring action could be used with fastener 12 that allows the user to pull the rack down lower towards the sink. A pair of cupboard doors is used to hide the dish rack when not in use by closing the cupboard doors. Thus the cabinet 10 would be mounted with an open bottom shelf below the dish rack 20 itself so that drainage can be directly into the kitchen sink. The dish rack 20 can have various layers of horizontal dish support members which can be rigid metal, plastic or wood bars or rods connected together as a unit for supporting different types of dishes, glasses, bowls, plates, and the like. The important aspect of the invention is that whatever the ultimate structure of the dish rack is that it is meant as a kitchen cabinet directly over the kitchen sink for direct drainage down to the sink. Thus the dish rack also serves as a storage area for dishes even when they are dry and the cabinet doors can be closed.

FIG. 1A shows the invention with dotted lines showing the dish rack 20 suspended in a kitchen cabinet 10 well above a kitchen sink 18 which is also shown in phantom. In the embodiment in FIG. 1A the covered cabinet doors are closed. FIG. 2 shows the same embodiment as in FIG. 1A with the cabinet doors open and the dish rack lowered to a different support area closer to the sink and with water drops reaching downwardly into the sink while the dishes and glasses are shown drying.

The dish rack itself can be many different forms as long as it has an open framed network so that water can drain downwardly from the cabinet area. The dish rack can be movable from a first position as shown in FIG. 1A with a first support to a second position as shown in FIG. 2A during the stacking and dishwashing operation. In fact, the dish rack can be loaded with dishes and actually placed back to the storage position shown in FIG. 1 with the doors closed so that it acts as another cabinet for storing dishes.

Figure 3:
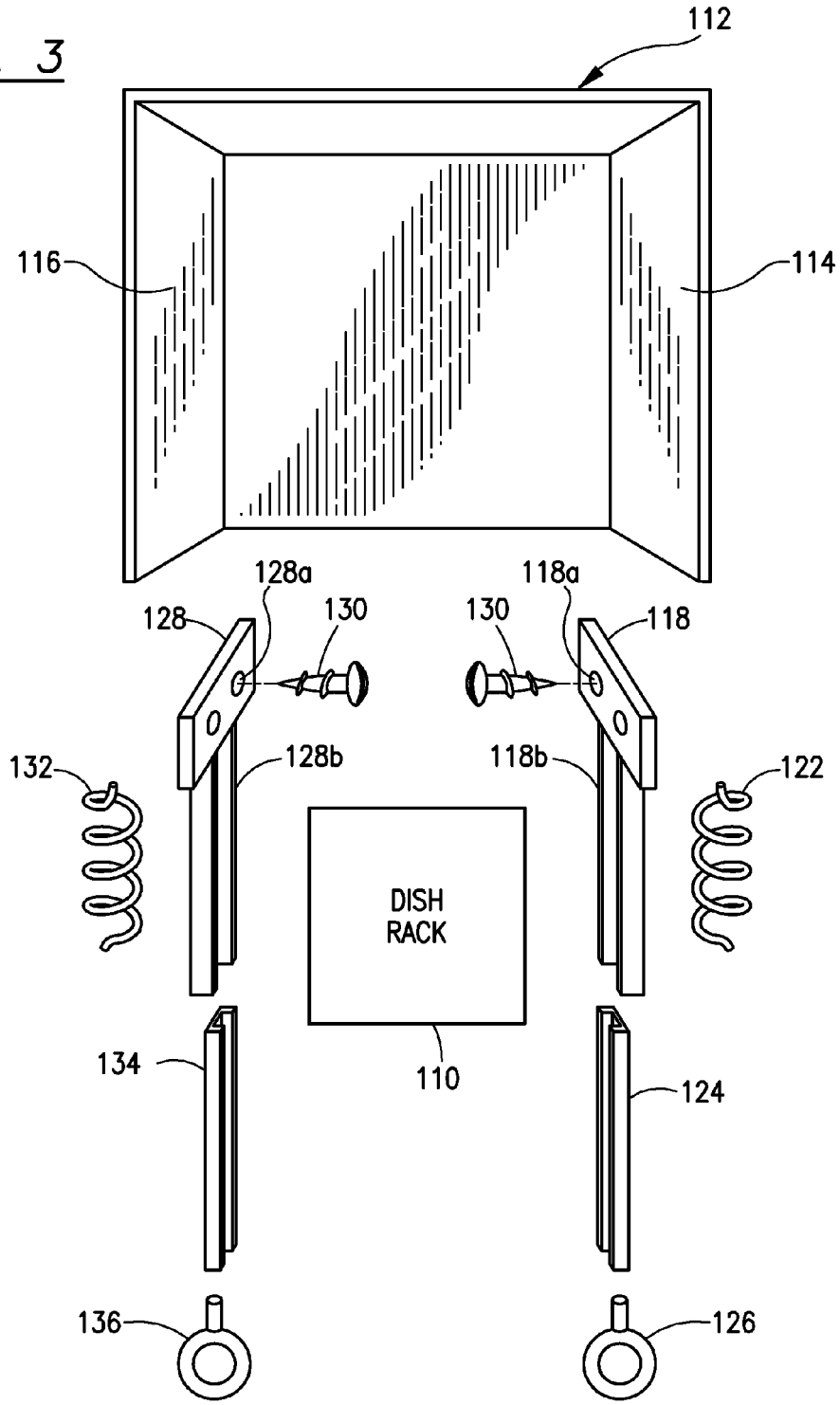
FIG. 3 shows a perspective exploded view of the invention.
Figure 4:
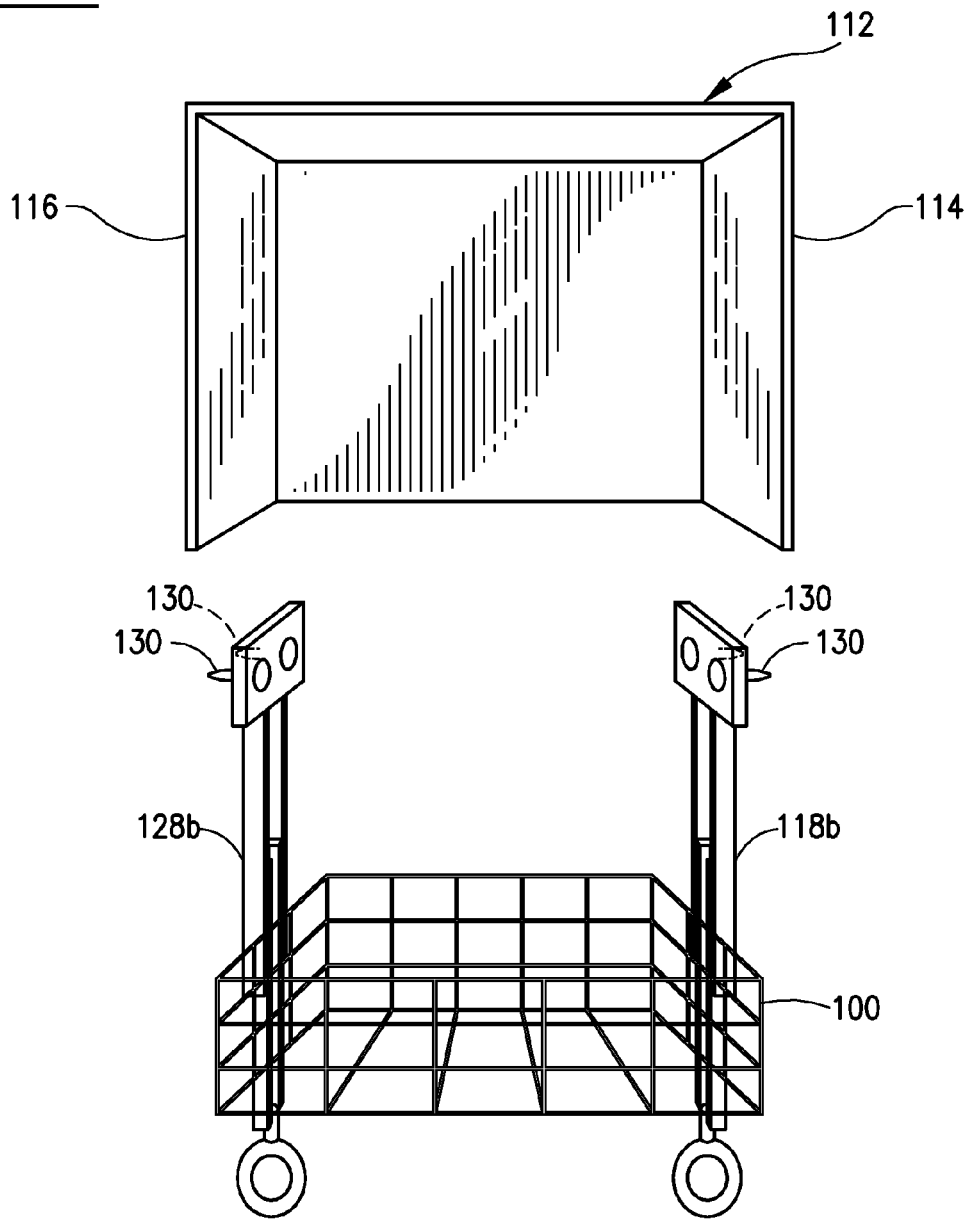
FIG. 4 shows a front elevational view of the invention.

Referring now to FIG. 3 and FIG. 4, the drawings show an exploded view of the dish rack installation kit which includes a dish rack 110 that is mechanically attached to brackets 124 and 134 on each side. A pair of handles 126 and 136 are connected either to brackets 124 and 134 or directly to dish rack 110. The brackets 124 and 134 are slideably connected to rigid vertical dish rack support members 118*b* and 128*b* on each side. The rigid vertical support members include top fastener plates 118 and 128 that include holes 118*a* and 128*a* respectively for receiving screws 120 and 130 for fastening the entire dish rack unit to the inside walls 114 and 116 of cabinet 112. Springs 122 and 132 can be connected to the dish rack to aid the user in moving the dish rack up and down with a load of dishes.

Installation of the invention is accomplished by providing the installation kit as a complete unit connected together that only requires lifting the dish rack and fastening screws on each side into the inside cabinet walls so that the entire dish rack system is firmly attached inside the cupboard. FIG. 4 shows the mounting of the installation kit below the opening of the cupboard in the mounting process.

The instant invention has been shown and described herein in what is considered to be the most practical and preferred embodiments. It is recognized, however, that departures may be made therefrom within the scope of the invention and that obvious modifications will occur to a person skilled in the art.

What is claimed is:

1. A dish rack installation kit for mounting a dish rack in a kitchen cupboard, said kitchen cupboard having a bottom shelf removed and open at the bottom comprising:

kitchen cupboard having a left side vertical wall and a right side vertical wall;

dish rack having a front side, a rear side, a left side and a right side opposite said left side for stacking dishes to be dried;

a first dish rack support member vertically attached to the left side of said dish rack, said dish rack support member projecting upwardly and downwardly relative to said dish rack and a second dish rack support member vertically attached to the opposite right side of said dish rack and projecting upwardly and downwardly;

said first dish rack support member having a top end and a bottom end and said second dish rack support member having a top end and a bottom end;

first handle attached to the bottom end of said first dish rack support member and a second handle attached to the bottom end of said second dish rack support member;

a flat rigid left cupboard wall mounting plate having a plurality of apertures for receiving screw fasteners and a flat rigid right cupboard wall mounting plate having a plurality of apertures for receiving screw fasteners;

a plurality of screw fasteners;

said left top cupboard wall mounting plate and said rigid right top cupboard wall mounting plate mounted to the inside left and right vertical walls of said kitchen cupboard by said screw fasteners; and a left rigid bracket having a first end and a second end, said left rigid bracket first end connected to said left covered wall mounting plate, said left rigid bracket having an inside longitudinal channel sized to receive said left dish rack support member, said left dish rack support member movably mounted inside said left bracket; and a right rigid bracket having a first end and a second end, said right rigid bracket first end connected to said right covered wall mounting plate, said right rigid bracket having an inside longitudinal channel sized to receive said right dish rack support member, said right dish rack support member movably mounted inside said right bracket.

2. A dish rack installation kit as in claim 1, wherein:

said kitchen cupboard having an open bottom and a pair of front opening doors for accessing said dish rack mounted therein; and said dish rack being movable by said first handle and said second handle vertically.

* * * * *